US008910795B2

(12) United States Patent
Steele et al.

(10) Patent No.: US 8,910,795 B2
(45) Date of Patent: Dec. 16, 2014

(54) MAGNETIC SEPARATOR

(71) Applicants: James Steele, Stillwater, MN (US); Leonard Williams, Buckinghamshire (GB)

(72) Inventors: James Steele, Stillwater, MN (US); Leonard Williams, Buckinghamshire (GB)

(73) Assignee: Dynamic Air Inc., St. Paul, MN (US)

( * ) Notice: Subject to any disclaimer, the term of this patent is extended or adjusted under 35 U.S.C. 154(b) by 0 days.

(21) Appl. No.: 13/987,012

(22) Filed: Jun. 25, 2013

(65) Prior Publication Data

US 2013/0292306 A1 Nov. 7, 2013

Related U.S. Application Data

(62) Division of application No. 13/134,156, filed on May 31, 2011, now Pat. No. 8,544,654.

(60) Provisional application No. 61/404,293, filed on Sep. 30, 2010.

(51) Int. Cl.

| | |
|---|---|
| ***B03C 1/00*** | (2006.01) |
| ***B03C 1/033*** | (2006.01) |
| ***B03C 1/02*** | (2006.01) |
| ***B03C 1/28*** | (2006.01) |
| ***B03C 1/08*** | (2006.01) |

(52) U.S. Cl.

CPC ..... *B03C 1/02* (2013.01); *B03C 2201/28* (2013.01); *B03C 1/0332* (2013.01); *B03C 1/286* (2013.01); *B03C 1/08* (2013.01)

USPC ..... 209/230; 209/225; 209/229

(58) Field of Classification Search

CPC ..... B03C 1/04; B03C 1/06; B03C 1/286

USPC ..... 209/213, 217, 223.1, 225, 228, 229

See application file for complete search history.

(56) References Cited

U.S. PATENT DOCUMENTS

| | | | | |
|---|---|---|---|---|
| 3,033,369 | A * | 5/1962 | Kragle | 209/223.1 |
| 3,672,496 | A * | 6/1972 | Williams | 209/38 |
| 4,229,288 | A * | 10/1980 | Akama | 209/212 |
| 4,457,838 | A * | 7/1984 | Carr | 209/223.2 |
| 7,438,187 | B2 * | 10/2008 | LaVeine | 209/38 |
| 8,360,247 | B2 * | 1/2013 | Baker | 209/223.1 |
| 8,544,654 | B2 * | 10/2013 | Williams et al. | 209/230 |
| 2012/0080359 | A1 * | 4/2012 | Williams et al. | 209/214 |

* cited by examiner

*Primary Examiner* — Joseph C Rodriguez

(74) *Attorney, Agent, or Firm* — Jacobson & Johnson LLC

(57) ABSTRACT

A magnetic separator comprising a vibratory conveyor for vibratorily flowing non-ferrous articles and articles containing ferrous material within the magnetic field of a transverse extending magnet to magnetically capture the articles containing the ferrous material while allowing the non-ferrous articles to flow therepast. The magnet is periodically retractable to remove ferrous articles magnetically adhered thereto. The use of a set of transverse extending magnets enables a continuous on-the-go separation of articles containing ferrous material from non-ferrous articles without having to shut down the vibratory conveyor.

5 Claims, 7 Drawing Sheets

MAGNETIC SEPARATOR

CROSS REFERENCE TO RELATED APPLICATIONS

This application is a divisional application of application Ser. No. 13/134,156 filed May 31, 2011 titled Magnetic Separator (pending), which claims priority from provisional application titled Magnetic Separator for Vibratory Conveyor Ser. No. 61/404,293 filed Sep. 30, 2010.

STATEMENT REGARDING FEDERALLY SPONSORED RESEARCH OR DEVELOPMENT

None

REFERENCE TO A MICROFICHE APPENDIX

None

BACKGROUND OF THE INVENTION

Various types of conveyor systems are known in the prior art. One important application for conveyor systems is that of conveying plastic and/or wire insulating material, normally in the form of plastic pellets, beads or the like, for processing to be used as insulating wire covering, with the conveyors providing for even distribution of the plastic and/or wire insulating material pellets as the pellets are carried or fed to a processing stage.

Normally the wire insulating material pellets or beads are gravity fed from a top mounted hopper onto a tray which uses vibrational forces to carry the pellets downstream and eventually into an output such as a bin, trough, chute or another hopper. Prior to being fed into the top mounted hopper, various additives such as colorants and UV inhibitors (in either liquid or pellet form) are often used and can be mixed into the pellets, which may introduce ferrous material into the pellets.

The addition of the additive to the pellets along with other materials that may have been picked-up prior to arriving at the top mounted hopper may result in the presence of ferrous materials which are attached to some pellets or contained in the body of some pellets. When used as a wire covering, it is obviously important that the plastic and/or wire insulating materials used to coat the wiring do not contain any ferrous materials. As such there is a need to separate and remove pellets containing ferrous materials from the plastic and/or wire insulating materials before further processing since ferrous metals in the insulation can create an electrical hazard. It is preferred that the separation and removal of ferrous materials and pellets, which contain ferrous material from the plastic and/or wire insulating materials, be accomplished prior to the processing stage of the plastic and/or wire insulating materials such as during conveying plastic and/or wire insulating for processing into electrically insulating wire covering. One of the difficulties with prior art magnetic separators is that it is difficult to completely remove all the articles that contain minute amounts of ferrous materials since the weight of the non-ferrous portion of article or other non-magnetic forces may be such that the magnetic attraction of the ferrous material in the article to the magnet is insufficient to separate the articles containing ferrous materials from the articles that are free of ferrous materials.

There is a need for a magnetic separator that has the ability to separate and remove articles containing minute amount of ferrous materials from those articles containing non-ferrous materials. This is partially true in the manufacture of wire insulation where the material in the articles used for making electrical wire insulation may be in the form of pellets of plastic or other wire insulating material. Typically, the pellets are processed to form an insulating cover for an electrical wire; however, even minute amounts of ferrous materials in the pellets can cause electrical problems. Typically, magnetic separators have not been able to separate articles with minute amounts of ferrous materials from those articles of non-ferrous materials. However, for safety reasons it is important to ensure that articles of ferrous material, article containing ferrous materials are separated from the articles of plastic and/or wire insulating material which are free of non-ferrous material before the articles are further processed.

BRIEF SUMMARY OF THE INVENTION

A magnetic separator vibratory feeder for vibratorily flowing ferrous and nonferrous articles downstream where the articles of ferrous materials or articles containing minute amounts of ferrous materials are vibrated into a position where the articles of ferrous materials or the articles containing minute amounts of ferrous material can be captured by the magnetic field of a magnet. The magnet can be retracted from a ferrous article capturing position to a nonferrous article capturing position where the ferrous articles or the articles containing minute amounts of ferrous material, which are magnetically adhered to the magnet, can be removed from the magnet so the magnet, which is free of ferrous articles, can be returned to the ferrous article capturing position in the vibratory separator to allow the vibratory separator to continue to remove ferrous articles or articles containing ferrous material from the vibratory flow of ferrous and non-ferrous articles. The use of a plurality of magnets located in series and transverse to the vibratory flow of articles permits one to continually separate and dispose of articles containing ferrous materials from those articles that are free of ferrous materials without having to stop the vibratory flow of articles through the magnetic separator. The use of a series of magnets each located downstream from each other further increases the ability to vibratorily capture articles that contain minute amounts of ferrous materials.

DESCRIPTION OF THE PREFERRED EMBODIMENT

Figure 1:
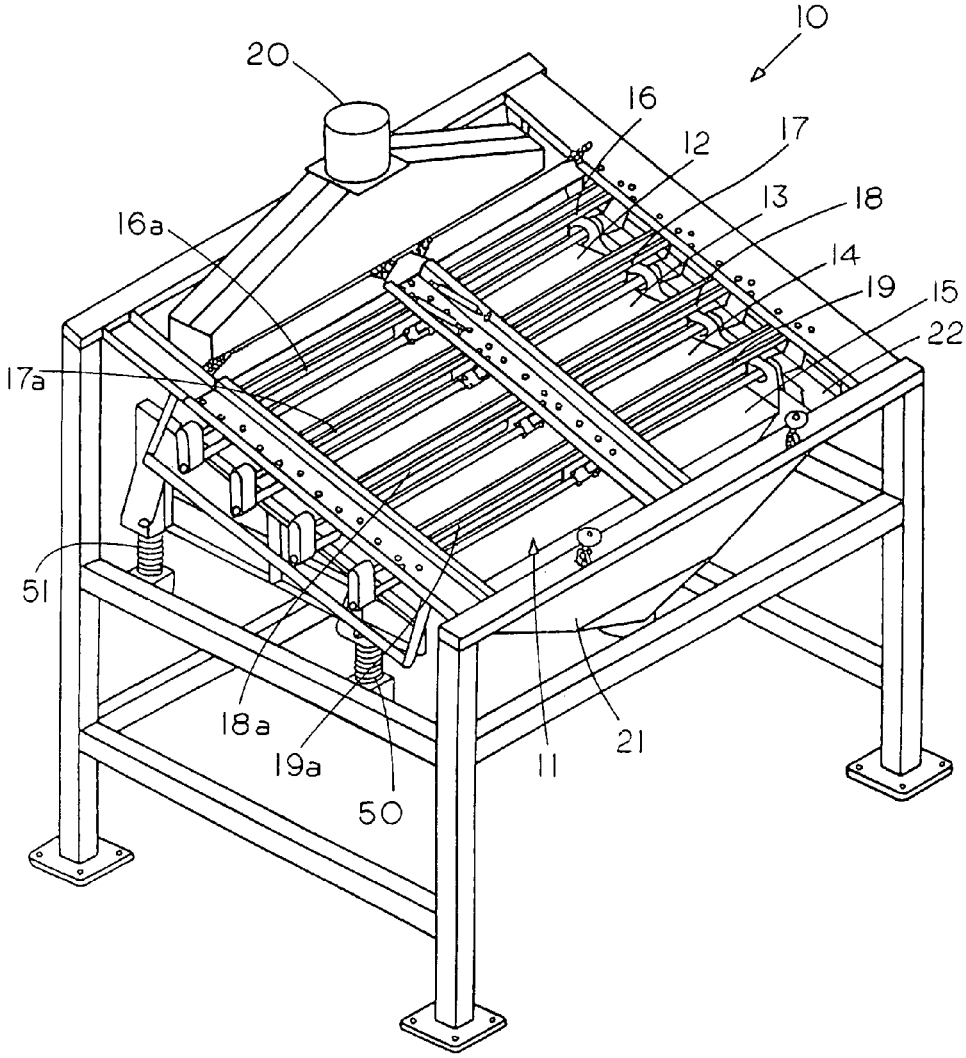
FIG. 1 is a perspective view showing the multi-tray or multi-pan vibratory conveyor system with the magnetic rods in a working position.

FIG. 1 is an illustrated embodiment showing a multi-tray or multi-pan vibratory conveyor system 10 capable of separating and removing plastic and/or wire insulating materials that contain a minute but significant amount of ferrous material from the plastic and/or wire insulating material that is free of the ferrous materials. Conveyor system 10 comprises a multi-tray vibratory conveyor or vibratory feeder 11, with the vibratory trays 12, 13, 14, and 15 more clearly shown in the insolated views of FIG. 3.

Figure 2:
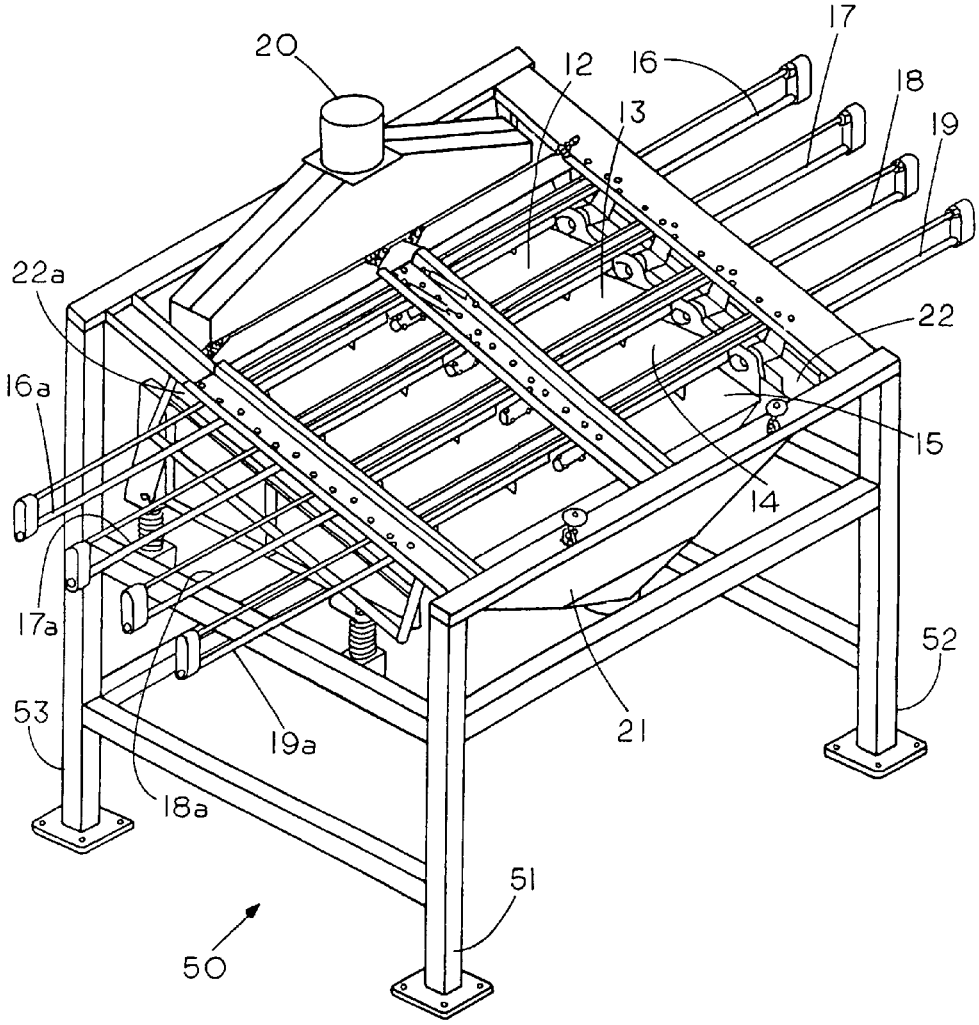
FIG. 2 is a perspective view showing the multi-tray or multi-pan vibratory conveyor system with the magnetic rods in a retracted condition or extended condition.
Figure 4:
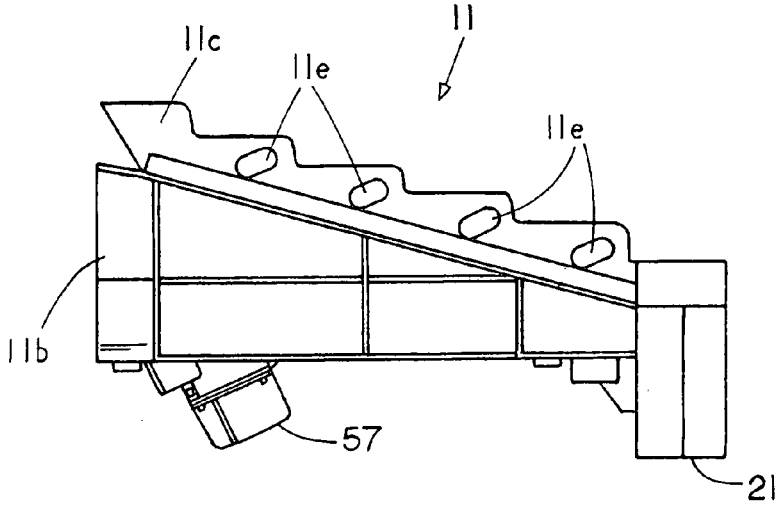
FIG. 4 shows a side view of the multi-tray vibratory conveyor or feeder of FIG. 3.

FIG. 4 shows a side view of vibratory support 11*b* together with the vibrator 57 and an output chute 21. The four vibrating trays 12, 13, 14, 15, which are shown vertically spaced from each other allow gravity to act on the articles thereon as the articles fall from tray to tray as the trays are vibrated in an up and down motion by vibrator 57. As can be seen in FIG. 1 and FIG. 2 a downstream tray 15 is located below, i.e. at a lower elevation, then its upstream trays 14, 13 or 12. Similarly, if tray 14 is a downstream tray it is located at a lower elevation than its upstream trays 12 and 13.

The means for vibration 57 may be an electrical motor having an eccentric weight although other methods and means of vibration of the trays may be used. The means for vibration 57 is coupled to trays 12, 13, 14, and 15 for vibrating trays in a manner to move articles on a tray downstream to the tray's output side and onto the input side of a next successive tray.

Figure 3:
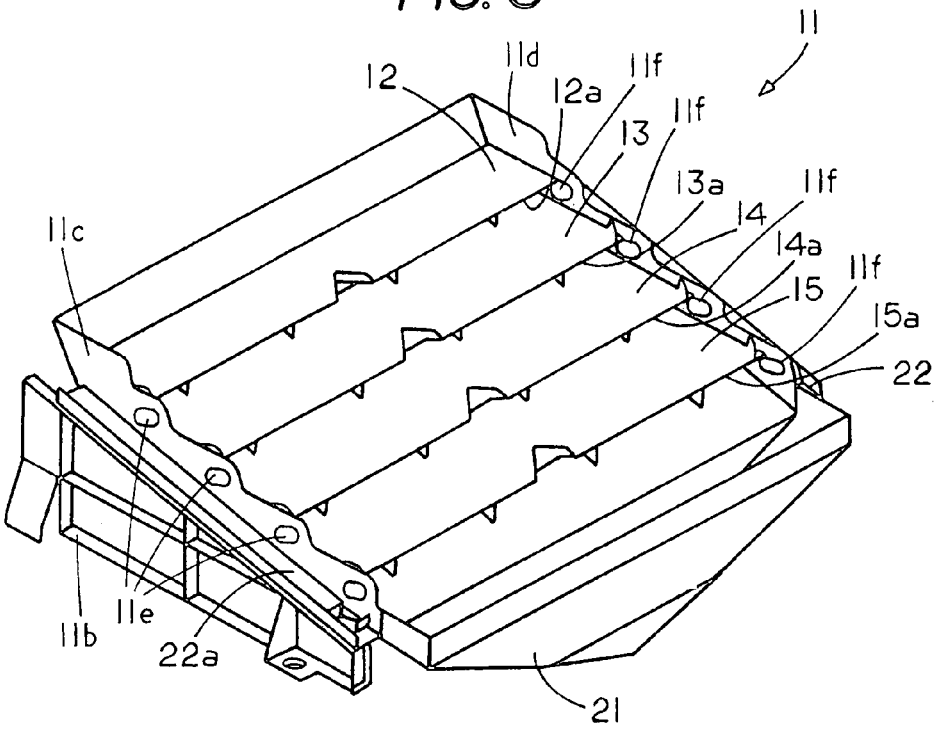
FIG. 3 is an isolated perspective view of a multi-tray vibratory conveyor or feeder.

FIG. 3 shows vibrating tray 12 having an output side 12*a*, which delivers material to vibrating tray 13. Similarly, tray 13 has an output side 13*a* that delivers material to, tray 14 has an output side 14*a*, tray 14 has an output side 14*a* that delivers material to, tray 15 has an output side 15*a* which delivers material to chute 21.

FIG. 1 shows the magnets 16, 16*a*, 17, 17*a*, 18, 18*a*, 19, and 19*a*, which are located at the output side of each tray, can magnetically grasp articles containing ferrous materials as they leave the output side of the tray. In the example shown the set of trays 12, 13, 14 and 15 comprises four separate generally planar trays although other supports for the articles may be used. FIG. 3 shows in isolated view a set of side rails 11*c* and 11*d* to laterally restrain the articles as the articles are vibrated from tray to tray.

While the embodiments is described with respect to removing articles containing ferrous materials from polymer plastics and the like, which are used in electrical wires, the invention may be used in other applications to remove ferrous articles, articles containing ferrous materials or articles that are responsive to a magnetic force without departing from the spirit and the scope of the invention described herein.

In the example of the illustrated embodiment of FIG. 1, located above the output side of each vibrating trays 12, 13, 14, 15 are a pair of elongated magnetic rods that are positioned transverse to the stream of materials that vibratorily flows from tray to tray. For example, located at output side 12*a* of vibrating tray 12 and mounted end to end is a pair of magnetic rods 16 and 16*a*, located at output side 13*a* of vibrating tray 13 is a pair of magnetic rods 17 and 17*a*, located at output side 14*a* of vibrating tray 14 is a pair of magnetic rods 18 and 18*a*, and located at output side 15*a* of vibrating tray 15 is a pair of magnetic rods 19 and 19*a*. Each of the magnetic rods is located above the tray and within a magnetic grasping distance of articles vibratorily flowing therepast. Each of the magnetic rods preferably is a rare earth magnetic made from a rare earth material that exerts a sufficient magnetic force to attract and hold ferrous materials or articles, which contain ferrous materials since the rare earth magnetic provide the strongest magnetic field for their size. The articles separated may take various regular or irregular shapes and may for example comprise pellets or the like. In separation of wire insulation matters the articles of plastic and/or wire insulating material that contain ferrous materials can be prevented from moving further downstream as the pellets which are free of ferrous materials are vibratorily carried downstream for further processing 11.

The magnetic separator vibratory feeder example of FIG. 1 and FIG. 2 includes at least four sets of magnets located in an end to end condition with each of the magnets independently retractable for removing ferrous articles adhered thereto. Although four sets of magnets are shown more or less sets of magnets may be used without departing from the sprit and scope of the invention. The use of multiple sets has the advantage of allowing the magnets to be retracted on-the-go to remove the ferrous articles therefrom without having to shut down the vibratory flow of articles through the magnetic separator 10 since the remaining set of magnets can magnetically capture the articles containing ferrous materials. As used herein an article containing ferrous material may be comprised entirely of ferrous material or may contain minute amounts of ferrous material with the remainder of the article being non-ferrous or non-magnetic responding material. While each set of magnets comprises two magnets located in an end-to-end with the magnets located traverse to the flow path of the vibratory articles a single magnet that transverses the flow path may also be used without departing from the sprite and scope of the invention.

In the operation of the multi-tray vibratory conveyor or feeder 11 with articles such as pellets, which contain both ferrous and non-ferrous materials, a top mounted hopper 20 having an adjustable hopper gate (not shown) feeds pellets of the plastic and/or wire insulating material onto the entry or input side of first vibrating tray 12 of a series of vibrating trays of the vibratory conveyor 11. A valve in the adjustable hopper gate has the ability to control the vibratory flow rate of the pellets being distributed onto the first vibrating tray. As the trays vibrate the pellets are conveyed downstream as they vibratorily hop up and down and then fall from one tray to another by the force of gravity in a fountain-like manner until the pellets reach an output 21, which may comprise a bin, trough, chute, or a secondary hopper for further processing.

As described earlier, to remove ferrous materials or articles containing ferrous materials from the articles being conveyed by the vibratory conveyor or feeder 11, at about the output side or downstream side of each tray is a magnetic member comprising a magnetic rod extending along the length of the output side of each tray and transverse to the vibratory flow path of the articles being conveyed by the vibratory conveyor or feeder 11. Each tray 12, 13, 14, 15 of multi-tray vibratory conveyor or feeder 11 has a separate pair of magnetic rods 16, 16*a*, 17, 17*a*, 18, 18*a*, 19, 19*a* associated in the same fashion. The magnetic rods 16, 16*a*, 17, 17*a*, 18, 18*a*, 19, 19*a* magnetically attract any of the articles being vibratorily conveyed that have a minute but significant amount of ferrous materials and prevents the articles with even the minute amounts of ferrous materials from moving on. By significant amount of ferrous material it is meant that the amount of ferrous material in the subsequent use of an end product can produce hazardous conditions. By minute amounts of ferrous materials in an article it is meant that the amount of ferrous material in relation to the non-ferrous material is so small that the non magnetic forces on the article such as the gravitational or electrostatic forces on the non-ferrous materials prevents the magnetic force acting on the minute portion of the ferrous material in the article containing the ferrous material from pulling the articles containing the ferrous materials away from the non-ferrous articles as both the articles containing ferrous materials and articles free of ferrous materials are conveyed beneath a magnet. Unfortunately, unwanted and potentially hazardous conditions can occur with an end product if the end product, such as an electrical wire insulation cover, if the cover contains minute but significant amounts of ferrous materials.

In the invention described herein one can remove articles containing minute but significant amounts of ferrous materials from articles that are free of ferrous materials through the vibratory feeding of the articles past a very powerful but short-range magnetic field. In some cases one may want to remove articles containing minute amount of ferrous material even though the amounts of ferrous materials may not be significant in an end product. In either case, articles containing ferrous materials or articles of ferrous materials can be efficiently separated from articles, which are free of ferrous materials.

In the invention described herein the vibratory energy applied to the articles in the vibratory feeder causes the articles to bounce up and down on the vibratory trays which brings unsupported articles deep into the magnetic field with the articles having at least a component of the velocity of the article, which is induced by vibration, directed toward the magnetic field. Thus, in the invention described herein the non-magnetic forces acting on the articles, which contain minute amounts of ferrous material, can be vibratorily overcome so that the magnetic force on the minute amount of ferrous material in the article is sufficient to separate the articles containing the minute amount of ferrous material from those articles that are free of ferrous material.

The non-ferrous materials continuously move from one tray to another and ultimately drop into an outlet port 21. Although the illustrated embodiment shows the use of four vibrating trays 12, 13, 14, 15, alternative embodiments may comprise a vibratory conveyor having at least one vibrating tray or a plurality of vibrating trays.

Figure 5:
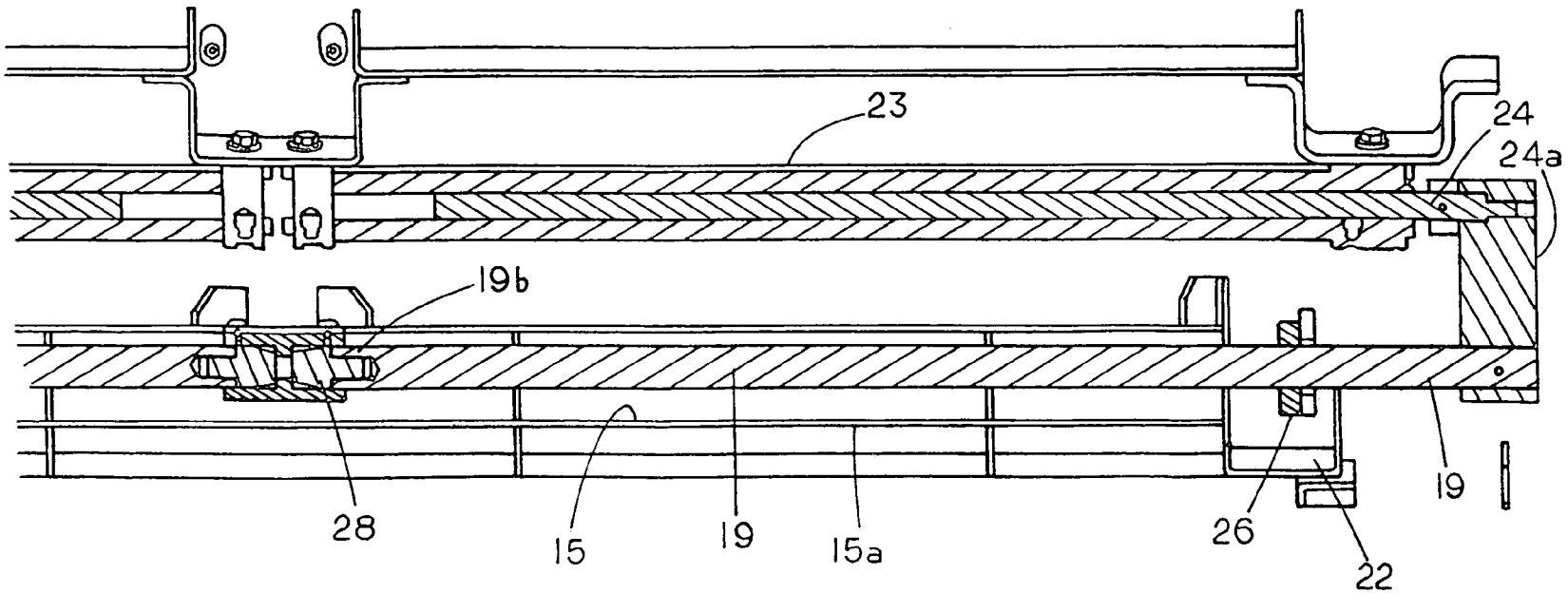
FIG. 5 is a partial cross-sectional view showing a one half or one side of the magnetic cleaning mechanisms of the multi-tray or multi-pan vibratory conveyor system.

At pre-determined times each of the magnetic rod 16, 16*a*, 17, 17*a*, 18, 18*a*, 19, 19*a* are mechanically moved or retracted lengthwise. FIG. 5 shows a pressure operated cylinder 23 for removing the magnetic rod 19 from the vibratory flow of material by extending the magnetic rod 19 laterally outward through a wiper 26 comprising a collar, a sleeve or the like to wipe off or detach the ferrous materials from the magnetic rod 19. Similarly, identical pressure operated cylinders are used to extend and retract magnetic members 16, 16*a*, 17, 17*a*, 18, 18*a*, and 19*a* through wipers.

Figure 6:
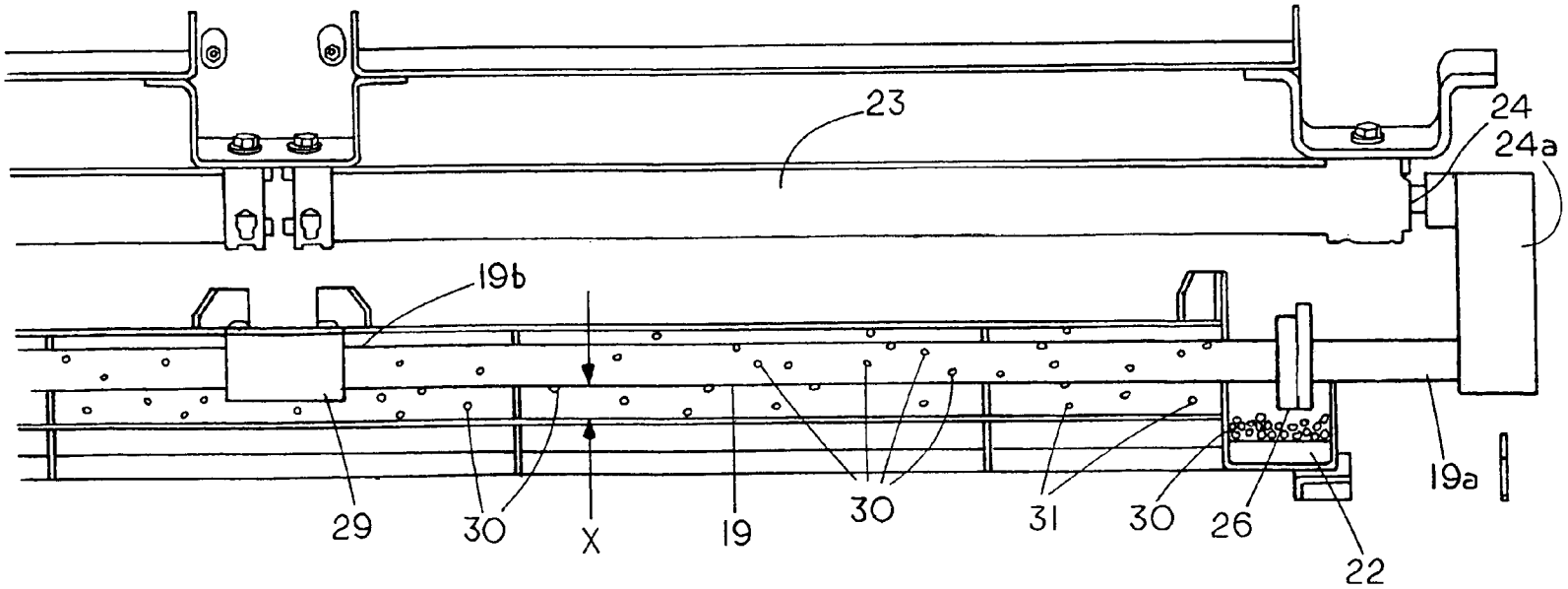
FIG. 6 shows a detailed partial cross-sectional side view of a multi-tray or multi-pan vibratory conveyor or feeder with the magnetic rods in the working position and articles moving in response to the vibrator action on the vibratory trays.
Figure 7:
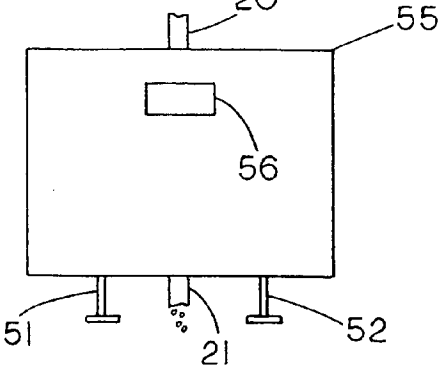
FIG. 7 is a front view of the vibratory feeder with a housing surrounding the vibratory feeder.

The pressure cylinder 23 may be controlled automatically and sequentially so that a set of magnetic rods is always present over the vibratory flow of articles to ensure that the ferrous articles do not escape capture, which provides the user the benefit of continuous and on-the-go removal and disposal of ferrous articles while still removing ferrous articles from the vibratory flow of ferrous and nonferrous articles. FIG. 6 shows that during the cleaning process of the magnetic rod 19 the ferrous materials 30, which are removed from the magnetic rods, are collected into a collection channel 22 for disposal. Similarly, a collection channel 22*a* (FIG. 3) on the opposite side of trays 12, 13, 14, and 15 includes collars (not shown) for removing ferrous articles removed from magnetic rods 16*a*, 17*a*, 18*a*, and 19*a* by an identical wiper sleeve located thereon (not shown). Each of the wiper sleeves may have a free floating feature to help compensate for any displacement of the magnetic rods 16, 16*a*, 17, 17*a*, 18, 18*a*, 19, 19*a* during their cleaning process. As shown in FIG. 3 and FIG. 4 the enlarged opening 11*e* and 11*f* isolates the movement of the vibratory trays from the magnetic rods since the vibratory trays can vibrate without contacting the magnetic rods.

It should be noted that the multi-tray vibratory conveyor or feeder 11 may continue operation as the transverse magnetic rods 16,16*a*, 17, 17*a*, 18, 18*a*, 19, 19*a* are separately and selectively cleaned. Alternatively, the multi-tray vibratory conveyor or feeder 11 may be stopped while the magnetic rods 16,16*a*, 17, 17*a*, 18, 18*a*, 19, 19*a* are being cleaned and restarted after the magnetic rods 16,16*a*, 17, 17*a*, 18, 18*a*, 19, 19*a* are returned to their working positions.

In order to isolate the magnetic rods 16, 16*a*, 17, 17*a*, 18, 18*a*, 19, 19*a* and to minimize the effect of the vibration forces on the magnetic rods 16, 16*a*, 17, 17*a*, 18, 18*a*, 19, 19*a*, a feature of the present invention is that the conveyor 11 is supported by a set of springs 50, 51 on one side and an identical set of springs (not shown) mounted on the opposite side of conveyor 11. The springs isolated the support for the magnetic rods 16, 16*a*, 17, 17*a*, 18, 18*a*, 19, 19*a* and their associated mechanisms from the vibratory conveyor 11.

FIG. 5 shows a cross sectional view of a magnetic rod 19 and an end view of the vibratory tray 15 that is located proximate the magnetic rod 19 while FIG. 6 shows a front view of the vibratory tray 15 and vibratory articles located proximate magnetic rod 19. The arrows indicate that the magnetic rod 25 is spaced a distance x above the vibratory tray 15 which is selected such that the vibratory articles, which are airborne through the vibratory action, are ensured of coming into the magnetic field which can contain articles having even minute amounts of ferrous material as the articles vibratory flow from tray 15. In the example shown the magnetic rod 19 is positioned so that the ferrous and nonferrous material being horizontally delivered by vibratory tray 15 pass either under or over and under the magnetic rod 19. That is, the momentum imparted to the articles 30 and 31 by vibratory tray 15 causes the articles to move up and down while the gravity in combination with angled surfaces and the flow of incoming articles causes the articles to vibratorily move downstream as the tray is vibrated. The momentum imparted to the articles through the vibratory action not only frees the articles from the surface of the support but also brings the articles, which contain ferrous materials within a stronger portion of the magnetic field, which surrounds the magnetic rod 19. The velocity of the vibratory articles in the vicinity of the magnetic rod are at either zero velocity or have a velocity component directed toward the magnetic field which enhances the ability of the magnetic member to capture those articles which have only minute amounts of ferrous materials. In order to prevent the articles containing the ferrous materials from being bounced off the magnetic rod the vibratory action may be limited so that the toss distance of the articles remains such that the articles can be captured if the articles actually impinge on the magnet due to the velocity imparted to the articles by the vibratory motion. The use of a horizontal delivery system as shown herein allows one to control or limit the feed rate of articles past the magnetic rods as well as bring the articles into close proximity of the magnetic rod 19. In contrast to devices that separate articles by allowing material to fall past a magnet the present device and method removes free fall momentum of a vertical flow of articles past a magnetic field, which may cause the articles with minute amounts of ferrous materials to escape from being captured by the magnetic field. Consequently, the vibratory feeding of articles to a position proximate the magnetic rod ensures one that the articles remain within the magnetic field sufficiently long so as to be captured. FIG. 5 and FIG. 6 illustrates the collar or wiper 26 which magnetic rod 19 is wiped clean of the magnetically held ferrous materials. The plunger 24 of a pressure operated cylinder 23 is coupled at one end to the outer end of a magnetic rod 19*a* and is operated in conventional fashion to withdraw or retract the magnetic rod 19 lengthwise from its operational position through a wiper comprising a sleeve or collar 26 which wipes off the magnetically held materials so the particles fall into a trough or chute 22, or the like for disposal. In the example shown the wiper comprises a collar 26 slideable with the radial clearance between the collar and the magnet smaller than the dimensions of the ferrous articles being removed by the magnet to prevent the ferrous articles from interfering with the sliding of the magnet therethrough. Although a collar is shown other means may be used for removing the articles from the magnet. For example, the magnetic member may be an electromagnet and the current can be turned off once the member is outside the vibratory flow of articles to allow the ferrous articles to be dropped into a collector located outside of the vibratory flow of the ferrous and non-ferrous articles. Alternately, one could manually remove the articles from the magnetic rod.

Figure 8:
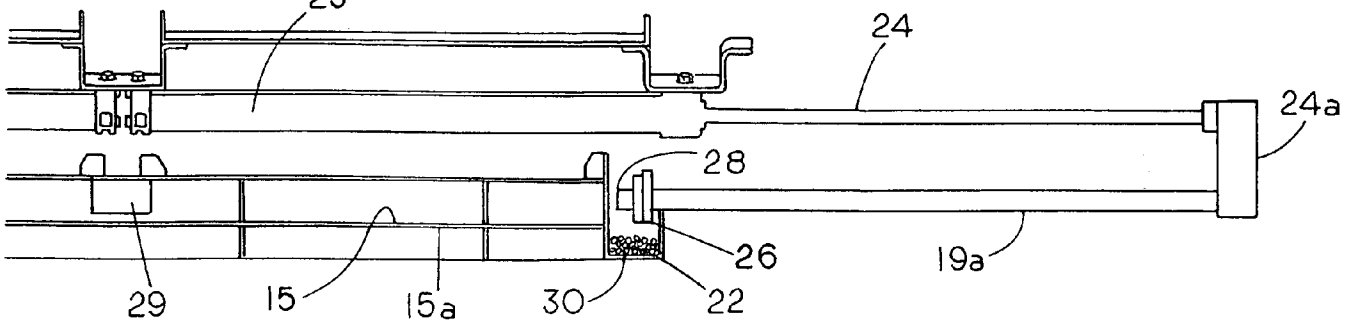
FIG. 8 is an isolated view of a magnetic member in the retracted position.

FIG. 8 shows the magnetic rod 19 in the extended condition with the wiper 26, which comprises a non-magnetic wiper located outside the set of trays 12, 13, 14 and 15 for wiping ferrous articles from the magnetic rod 19 onto a collector tray 22 as the magnet 19 is displaced laterally outside the set of trays 12, 13, 14 and 15.

Figure 5A:
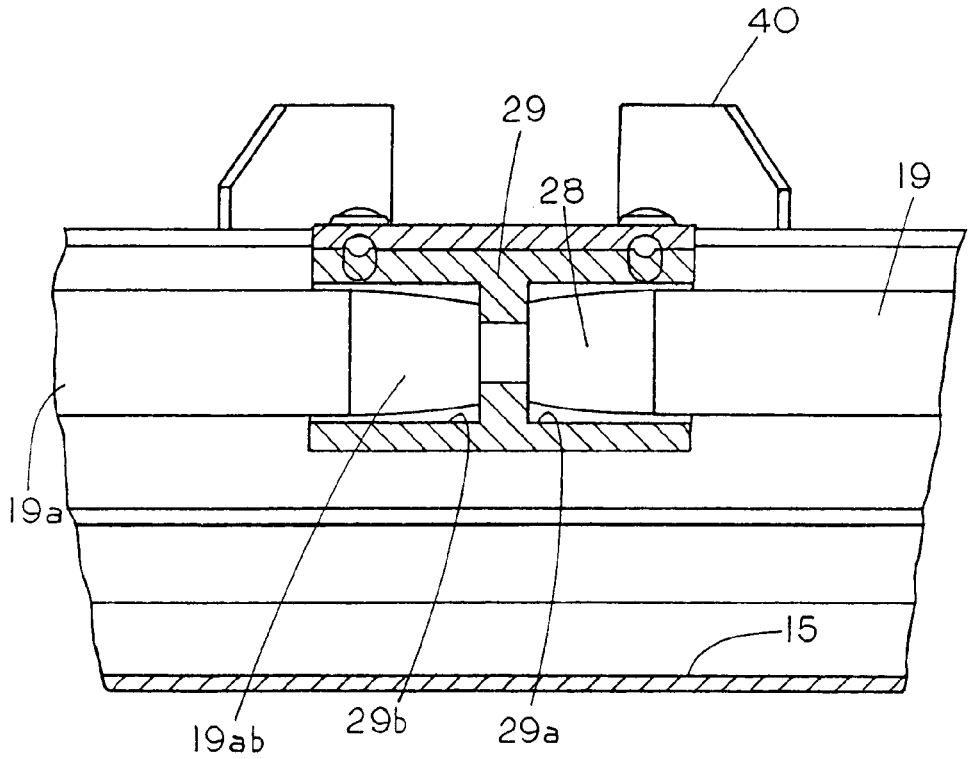
FIG. 5A is a partial cross-sectional view showing a the cantilevered ends of end to end magnetic members engaging an end support.

In order to avoid overly extending the magnetic rod during cleaning, each rod is preferably bifurcated lengthwise and each half is operated by its own associated cylinder. FIG. 5 and FIG. 5A illustrate only one half or one side of the rod cleaning mechanisms but each side operates in the same fashion and with the same associated mechanisms. FIG. 5*a* is an enlarged view showing a pair of magnets 19 and 19*a* that each extend partially across the width of the tray toward each other in an end to end relationship with a cantilevered end 28 of rod 19 and a cantilevered end 19*ab* of rod 19*a* supported by a center rail 40 having a housing 29 having axially aligned cavities 29*b* and 29*a* on opposite ends for receiving the ends of the magnets to allow the housing 29 to engage and support the cantilevered ends of the magnetic rods 19 and 19*a* during the vibratory flow of ferrous and non-ferrous articles through the magnetic separator 10.

FIG. 6 illustrates the ferrous articles 30 and non-ferrous articles 31 bouncing on the vibratory tray 22 as the articles move downstream on the vibratory tray 22. The vibratory action of the vibratory tray 22 causes the articles 30 and 31 to move up and down while gravity causes the articles to fall downstream from tray to tray. As the articles move downstream due to the vibration of the vibratory tray 22 the articles may collide with the magnetic separator or they may pass either under or over the magnetic rod 19. In either case the articles 30 are brought into close proximity of the magnetic rod 19 due to the vertical vibratory momentum imparted to the articles, which enables the magnetic field surrounding rod 25 to efficiently capture any articles that contain even minute amounts of ferrous materials that are vibratory flowed into above or below the magnetic rod 19. While only vibratory tray 15 has been described in relation to a magnetic rod the other vibratory trays also deliver articles to position where the ferrous articles can be capture and removed from the system in an identical or similar manner.

To ensure that the magnetically held materials are wiped off the magnetic rods and deposited for disposal, each magnetic rod may have a non-magnetic member attached in some conventional fashion at its inner end. FIG. 5A shows a non-magnetic member 28 forming a nonmagnetic end of the magnetic rod 19. When the non-magnetic member 28 passes through the wiper sleeve 26 any magnetically held material will then fall off the wiper sleeve 26 and into the trough or chute 22, or the like for disposal. Similarly, the other magnetic rods include identical non-magnetic ends and will not be described herein. While the articles that are separated may be pellets that contain ferrous material the system is suitable for separating other types of articles of ferrous materials from articles, which do not contain ferrous materials. Typical of the examples of materials having articles that can be separated include articles of sugar, salt, sand or any other materials that can be vibratorly moved downstream past the magnetic member by the vibratory trays.

Thus the invention comprises a vibratory method of separating articles containing ferrous materials from a vibratory flow of articles containing both ferrous articles and non-ferrous materials by directing a batch of ferrous articles and non-ferrous articles to a set of vibratory trays 12, 13, 14 and 15 located in series while vibrating the vibratory trays to direct a vibratory flow of the batch of ferrous and non-ferrous articles downstream from tray to tray under the influence of gravity. By placing a set of magnetic members 16, 16*a*, 17, 17*a*, 18, 18*a*, 19, and 19*a* as a set of partial transverse obstructions to the vibratory flow of the batch of ferrous and non-ferrous articles from tray to tray one can magnetically capture the ferrous articles 30 with at least one of the magnetic members as the ferrous articles 30 and non-ferrous articles 31 vibratorily flow downstream in response to the vibratory action while permitting the nonferrous articles 31 to pass over or under the magnetic member.

FIG. 6 illustrates that to remove the captured ferrous articles 30 from the magnetic member, the magnetic member 19*a* can be withdrawn from a magnetic grasping condition proximate the vibratory flow of ferrous and non-ferrous articles by the power cylinder 23, which is coupled to the magnetic member 19*a*. That is as the ram in the power cylinder 23 is extended the link 24*a* extends the magnetic member 19*a* laterally outward through the wiper or collar 26, which removes the ferrous articles 30 therefrom without allowing the ferrous articles 30 to fall back into the vibratory flow of articles from tray to tray. 16. As can be seen in the example of FIG. 6, the magnet 19*a* is located above the tray 12 but below a vibratory article toss distance so that the magnet at least partially obstructs the vibratory flow of ferrous and non-ferrous articles past magnet 19. The vibratory toss distance being the maximum vertical distance the articles are tossed vertically upward in response to the vibratory action applied to the vibratory trays, which is dependent on the degree of vibration applied to the vibratory trays. Thus, the vibratory flow of articles brings the articles into vertical proximity of the magnet 19 and correspondingly deeper into the magnetic field proximate the magnet 19 which allows the ferrous articles to be more effectively captured than if the articles were being conveyed without the benefit of the vibratory action thereto. In operation, the vibration of the vibration tray is maintained so that the velocity of approach of the vibrating articles to the magnet do not cause the articles which contain even minute amounts of ferrous materials to bounce off the magnet and out of the influencing part of the magnetic field and thus avoid capture.

In one aspect of the invention one places the set of magnetic members 16, 16*a*, 17, 17*a*, 18, 18*a*, 19, and 19*a* as partial transverse obstructions to the vibratory flow of ferrous and non-ferrous articles from tray to tray and removes the ferrous articles from one of the set of magnetic members while maintaining the remaining magnetic members in a magnetic grasping position to thereby allow ferrous articles to be continually removed without interrupting the vibratory flow of the ferrous and nonferrous materials to thereby remove the ferrous material from the one of the set of magnetic members.

The method of removing the articles containing ferrous materials comprises the step of sliding the magnetic member 19*a* through a wiper 26 located outside the set of trays 12, 13, 14 and 15 to allow the ferrous articles 30 adhered thereto to be removed outside of the vibratory flow of ferrous and non-ferrous articles.

As FIG. 6 shows the magnetic member 19*a* has been placed transverse and within the vibratory flow path of the ferrous articles 30 and nonferrous articles 31. As used herein the term ferrous articles is intended to include particles, pellets or other shapes of materials which may contain small or minute amounts of ferrous materials or articles which are solely comprised of ferrous materials.

I claim:

1. A method of separating articles containing ferrous materials from articles containing non-ferrous materials comprising the steps of:

placing a batch of articles containing ferrous materials and non-ferrous materials on a vibratory support;

placing a set of vibratory trays in series and placing a set of magnetic members transverse to the vibratory flow of the batch of articles from tray to tray;

vibrating the vibratory support to bring the batch of articles deeper into a magnetic field of a magnetic member of the set of magnetic members;

magnetically capturing the articles containing ferrous materials on the magnetic member as the ferrous articles vibratory flow past the set of magnetic members while the articles containing non-ferrous materials bypass the set of magnetic members; and removing the articles containing a ferrous material from one of the set of magnetic members while maintaining the remaining magnetic members of the set of magnetic members in a magnetic grasping position to thereby allow the articles containing ferrous materials to be removed from the vibratory flow without interrupting the vibratory flow of the batch of articles.

2. The method of claim 1 including the step of removing a magnetically captured article containing ferrous materials from the magnetic member when the magnetic member is located outside of the vibratory flow of the batch of articles.

3. The method of claim 1 including the step of sliding each of the set of magnetic members through a wiper located outside the set of trays to remove the articles containing a ferrous material adhered thereto.

4. The method of claim 1 wherein the step of placing the set of magnetic members transverse to the vibratory flow path of the batch of articles containing the ferrous material and non-ferrous materials removes articles containing a minute amount of the ferrous material.

5. The method of claim 1 including the step of vibrating the batch of articles sufficiently to toss the articles upward from a surface of the vibratory support and toward the set of magnetic members, wherein the set of magnetic members can magnetically grasp articles containing a ferrous material.

* * * * *